US009204217B2

(12) United States Patent
Umbauer et al.

(10) Patent No.: US 9,204,217 B2
(45) Date of Patent: Dec. 1, 2015

(54) MICROPHONE FILTER SYSTEM

(71) Applicant: AKG Acoustics GmbH, Vienna (AT)

(72) Inventors: Thomas Umbauer, Gabiltz (AT); Wolfgang Satra, Wiener Neustadt (AT); Gino Pavlovic, Vienna (AT)

(73) Assignee: AKG Acoustics GmbH, Vienna (AT)

( * ) Notice: Subject to any disclaimer, the term of this patent is extended or adjusted under 35 U.S.C. 154(b) by 496 days.

(21) Appl. No.: 13/665,012

(22) Filed: Oct. 31, 2012

(65) Prior Publication Data

US 2013/0114833 A1 May 9, 2013

(30) Foreign Application Priority Data

Nov. 4, 2011 (EP) ..... 11 450 137

(51) Int. Cl.
*H04R 3/04* (2006.01)

(52) U.S. Cl.
CPC ..... *H04R 3/04* (2013.01)

(58) Field of Classification Search
CPC ..... H04R 3/00; H04R 3/02; H04R 3/04
See application file for complete search history.

(56) References Cited

U.S. PATENT DOCUMENTS

| | | | | |
|---|---|---|---|---|
| 1,725,954 | A | 10/1923 | Bethenod | |
| 2,068,698 | A | 6/1938 | Penn | |
| 4,041,247 | A | 8/1977 | Briley | |
| 4,226,248 | A * | 10/1980 | Manoli | 600/586 |
| 4,508,940 | A * | 4/1985 | Steeger | 381/317 |
| 6,731,748 | B1 * | 5/2004 | Edgar, III et al. | 379/387.01 |
| 6,914,992 | B1 * | 7/2005 | van Halteren et al. | 381/113 |
| 2002/0118843 | A1 * | 8/2002 | Totani et al. | 381/77 |
| 2007/0076900 | A1 | 4/2007 | Kellermann et al. | |

FOREIGN PATENT DOCUMENTS

WO WO01/08442 2/2001

OTHER PUBLICATIONS

European Search Report from corresponding European Patent Application No. EP 11 450 137.2, 7pgs. dated Apr. 16, 2012.

* cited by examiner

*Primary Examiner* — Simon Sing
(74) *Attorney, Agent, or Firm* — Brooks Kushman P.C.

(57) ABSTRACT

A microphone filter system for outputting an audio signal independent of electrical impedance of downstream devices. This system may include a filter section and an audio transformer that facilitate the outputting of the audio signal.

4 Claims, 5 Drawing Sheets

MICROPHONE FILTER SYSTEM

BACKGROUND OF THE INVENTION

1. Priority Claim

This application claims the benefit of priority from European Patent Application No. 11 450 137.2, filed Nov. 4, 2011, which is incorporated by reference.

2. Technical Field

The invention relates to filter systems for microphones.

3. Related Art

In general, a distinction can be made between passive and active microphones, with dynamic microphones belonging to the passive microphone group and condenser and electret microphones belonging to the active microphone group, for example, condenser microphones and electret microphones, also called electrostatic microphones, may be used in a recording area and may use a supply voltage that may be provided by a connected device, such as a mixer or an effects unit. In condenser microphones, a supply may provide polarization voltage for electrodes of a microphone capsule and an operating voltage for an associated microphone amplifier. In electret microphones, a supply may provide an operating voltage for the microphone amplifier, since the polarization voltage may be provided by a charged Teflon coating.

In contrast, dynamic microphones may not use an external power supply, because such microphones may use direct conversion of sound vibrations into an electrical voltage. Because of this direct conversion, dynamic microphones may be useful for live concerts and on-stage use, for example.

Nevertheless, with this benefit, there are tradeoffs. For example, with dynamic microphones quality of sound output may depend on electrical impedance of downstream devices.

SUMMARY

A microphone filter system that can control quality of sound output by outputting an audio signal independent of electrical impedance of downstream devices. To output such a signal, the system may use a transformer and filter section that includes a signal converter, an active filter, a summing unit, and an amplifier.

The active filter may include filter blocks for modifying signal components of a microphone input signal, and the summing unit may include one or more potentiometers for further adjusting the modified signal components. These parts in conjunction with a transformer may modify frequencies or phase characteristics of the microphone input signal as a whole or per signal component. Then, for example, the transformer may output the audio signal independent of electrical impedance of downstream devices.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
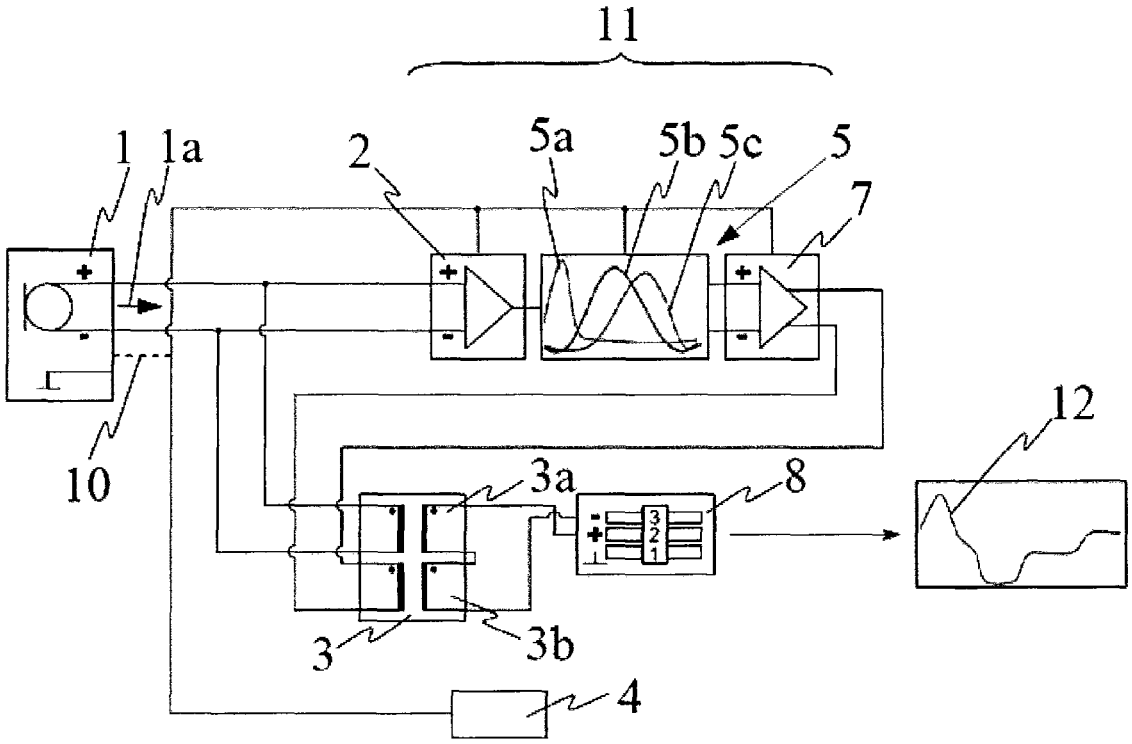
FIG. 1 depicts an example block diagram of an example filter system.

In various situations, passive microphones, such as dynamic microphones, may be used over active microphones. Such situations may include instances when an external power supply is optional.

Dynamic microphones may be independently connected to one or more downstream acoustic devices (amplifier or recording devices), while some dynamic microphones may have a built-in passive filter. Dynamic microphones with a passive filter may change the sound of the microphone and adapt the microphone to a particular application field without an external power supply. For example, a change in an audio signal can be made through a passive filter built into a microphone housing. Such a passive filter may be designed with switchable resistor-inductor-capacitor (RLC) elements and may allow for small changes in a transfer function or microphone sound.

Since passive filters may be designed for passive use, a voltage source for an active filter may not be available with dynamic microphones. Also, related to this trait, passive microphones may be limited to providing frequency-dependent attenuation without boost of microphone sound. Also, operation of passive filters may be dependent on electrical impedance of downstream equipment (such as one or more amplifiers, mixers, or recording devices). Because of this dependency, for example, operation of a dynamic microphone may result in two different amplifiers providing two different sounds.

To avoid unwanted and disturbing signal peaks, electrical passive filters may be embedded in a microphone. Such electrical passive filters can be permanently active or may be activated or deactivated with switches. Typical filters may include, for example, a 70 Hz high-pass filter, whereby low-frequency impact and handling noises can be suppressed. For condenser and electret microphones, such filters maybe designed for an active power supply, which may already be present in such microphones. In contrast, dynamic microphones may use passive RLC filters where changes to a frequency response may be carried out by RLC absorption or anti-resonant circuits.

Passive filters may produce passively filtered signals that have lower power levels than respective input signals. Also, because there may not be a power boost or controlled voltage, for example, dynamic microphones may provide an inconsistent output signal. Consistency may be dependent on impedance of a connected device, such as a mixer and/or an effects unit, and on an actual input source (such as a microphone capsule). Both source impedance and input impedance of passive filters have an influence on response characteristics of a dynamic microphone. This can cause microphones with the same presettings to produce different sound, depending on connected equipment. To avoid this inconsistency, equalizers may be used, which may be arranged between a dynamic microphone and an amplifier, for example.

To achieve an audio signal independent of electrical impedance of a downstream device, active filtering in some cases may be used. Active filtering can be employed by components in condenser and electret microphones. Alternatively, filtering may be arranged for a dynamic microphone that limits the variation in an audio signal that may be caused as a result of varying impedances of downstream devices. For example one or more filters or filter sections, which may include a signal converter, an active filter, a summing unit, and an amplifier or pole changer, arranged with an audio transformer with two pairs of coils, may provide such functionality. Such functionality may be provided since this circuit may have low output impedance, regardless of existing peripherals or the different impedances of individual downstream devices.

The power supply voltage used for the active parts of the filter(s), may be provided, for example, by a connected mixer. Frequency or phase characteristics of an input signal may be passed via a filter section and added or subtracted with the original input signal by a transformer, depending on phase shift of the original input signal.

The filter section may include at least one filter block for a specific frequency range. And, the at least one filtering block may be operated by touch, rotary, and/or tilting elements external to a microphone's housing, for example.

Phantom powering may be used in order to drive an impedance converter and a downstream preamplifier contained in a condenser and/or an electret microphone, as well as polarization in a condenser capsule. In audio engineering, phantom powering may represent power supply of microphones with a DC voltage between 9 and 48 V, for example. In practice, a supply voltage of 48 V±4 V (P 48 phantom power) may be more widespread. Alternatively, using the filter section, a microphone may be operable when phantom powering is lacking.

With phantom powering connected, different audio signal characteristics can be generated by changing a frequency response. The filter section may have an advantage in that it may be passively operated without power supply and without active influence of a frequency response, like a dynamic microphone. However, in response to the microphone being in an active mode, and so being operated with a power supply, the frequency response can be changed. Due mainly to low output impedance of the filter section, the same result can always be obtained with different connected devices. These influences of the microphone sound can be differentiated with respect to a quality of a filter curve, and a level and a frequency of an input signal.

FIG. 1 depicts a block diagram of an example filter system. The filter system may be constructed in the form of a controller. An input signal coming from a microphone 1 may be applied to an audio transformer 3 and a filter section 11. The audio transformer 3 may be a low frequency (LF) transformer. The output signal of the filter section 11 may be fed back to the audio transformer 3.

The filter section 11 may include a signal converter 2 and an active filter 5 (such as a level filter). The filter section 11 may also include one or more filter blocks for one or more respective frequency ranges, and an amplifier and/or pole changer (such as an amplifier 7). The microphone 1 may feature a balanced audio output, including an in-phase output (+) and an out-phase output (−).

The audio output may be an original input signal la of the filter system and may be transmitted to the audio transformer 3. The audio transformer may include two pairs of coils 3*a* and 3*b*; and the coils may have the same transformer core. Also, the audio output may be transmitted to the signal converter 2. The illustrated coil pairs 3*a* and 3*b* in this case may have a shared secondary winding, and/or, for example, a continuous secondary winding can be used.

The signal converter 2 may convert a symmetrical signal to an asymmetrical signal and pass it on to the active filter 5. The active filter 5 may perform desired changes. For example, the active filter 5 may include three filter blocks for three different frequency ranges (such as signal components 5*a*, 5*b*, and 5*c* of an asymmetrical signal). The output of the active filter 5 may be passed on to an amplifier and/or pole changer such as the amplifier 7. Also, the output of the active filter may be passed on to an input of the audio transformer 3. In one example, the input of the audio transformer 3 may include a lower pair of coils 3*b*. A voltage supply 4 (such as phantom powering or a power supply via an accumulator, a battery, or a mains adapter) may be connected to the signal converter 2, the active filter 5, and/or the amplifier 7; and may provide power to these components.

An output of audio transformer 3 may be a connector, such as a standardized XLR connector. The connector may provide, for example, a connection to a mixer 8. The mixer 8 may be powered by the power supply 4, which may facilitate electrical coupling between the mixer and the transformer 3. Also, a filtered output signal 12 may be transmitted via such a connection.

Where the mixer 8 is not provided, or a power supply for active filtering is not provided, for example, the microphone 1 can be operated without filtering, such as in a passive mode. In the passive mode, for example, an input signal la may be communicated unfiltered via the audio transformer 3 to the mixer 8.

Figure 2:
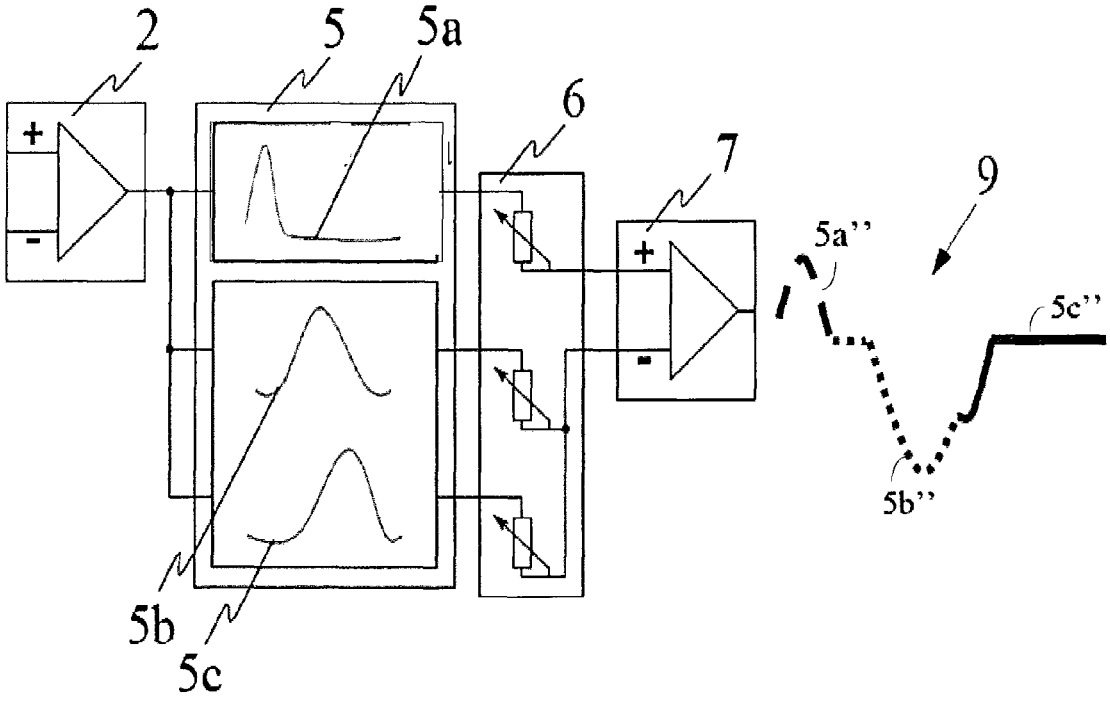
FIG. 2 depicts an example illustration of an example filter section.

FIG. 2 depicts an example illustration of an example filter section. Such as the filter section 11 depicted in FIG. 1. In the figure, for example, the input signal la may arrive from the signal converter 2 to the active filter 5. In the active filter 5, for example, included may be three filter blocks for three different frequency ranges, such as the signal components 5*a*, 5*b*, and 5*c* of an asymmetrical signal. In such an example, an increase for the signal component 5*a* and a decrease for the signal components 5*b* and 5*c* may occur, and such settings may occur from a downstream summing unit 6. The downstream summing unit 6 may include potentiometers, such as three respective potentiometers for the signal components 5*a*, 5*b*, and 5*c*. A downstream amplifier and/or pole changer (such as amplifier 7) may combine, amplify, pole change, and/or attenuate, phase sections, such as combining processed signal components 5*a*", 5*b*", 5*c*" into a signal 9 (as discussed with respect to FIG. 4).

Figure 3:
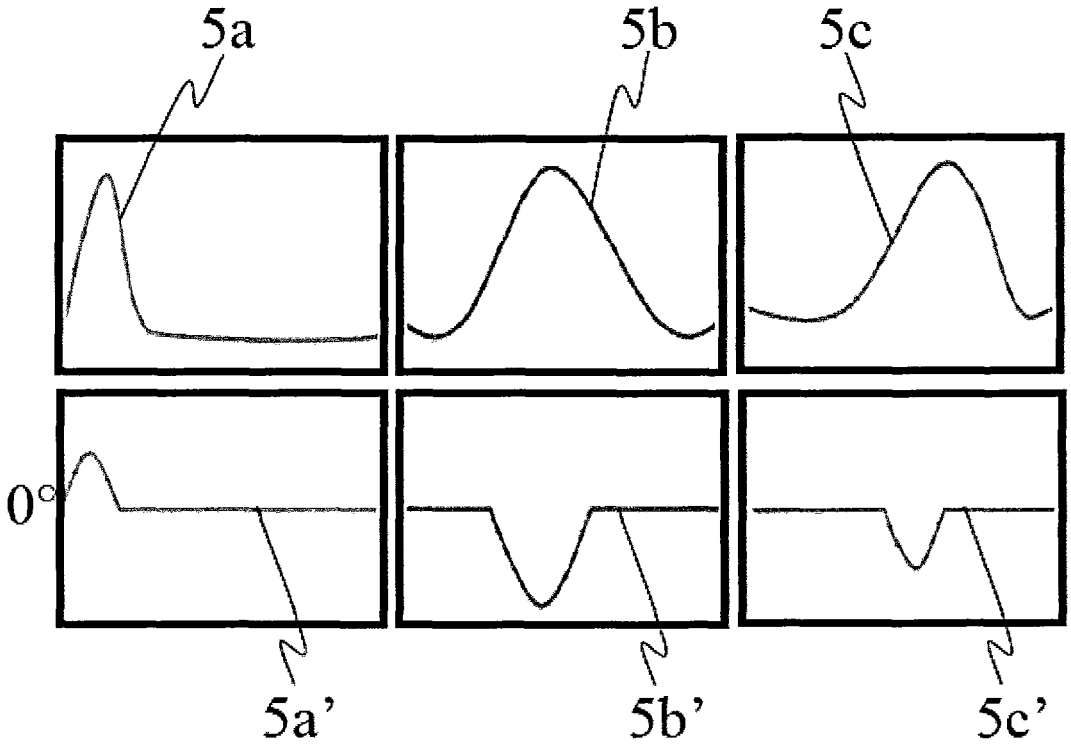
FIG. 3 depicts an example waveform of three different example frequency filter blocks of an example active filter.

FIG. 3 depicts an example waveform of three different example frequency filter blocks of an example active filter. For example, this figure depicts phase changes performed by the amplifier and/or pole changer, such as amplifier 7. The phase changes in this figure are represented by the signal components 5*a*, 5*b*, and 5*c* of the asymmetrical signal (depicted in the upper row) and the processed signal components 5*a*', 5*b*', 5*c*' (depicted in the lower row). In this case, the signal components 5*a*, 5*b*, and 5*c* have been changed to the processed signal components 5*a*', 5*b*', and 5*c*'. Such changes to the signals, by phase shifting or another signal processing function, may depend on filter settings through potentiometers of the summing unit 6. For example, for a frequency increase at an output of the filter system, a signal may be passed without phase change; while for a frequency decrease at the output, the signal may be shifted by a predetermined number of degrees, such as 180°.

In one example, there may be respective filter blocks for individual signal components, such as the signal components 5*a*, 5*b*, and 5*c*. These component frequencies may be adjustable with one or more potentiometers in summing unit 6. Also, they may be adjustable with one or more filter blocks, such as the filter blocks used by the active filter 5. For example, the active filter 5 may be composed of three filter blocks. For example, the signal component 5*a* of a corresponding filter block has a setting of a first frequency (such as 40 Hz). The signal component 5*b* of a corresponding filter block has a setting of a second frequency (such as 700 Hz). The signal component 5*c* of a corresponding filter block has a setting of a third frequency (such as 2700 Hz). These frequencies may be selected and/or adjusted by a control mechanism.

In FIG. 3, in the first column, for the signal component 5*a*, a frequency increase occurs. In the second and third columns, for the signal components 5*b* and 5*c*, a frequency decrease occurs. Whether a frequency increase or a frequency decrease occurs for a signal component 5*a*, 5*b* or 5*c*, such an increase or decrease may be adjustable using a respective potentiometer in the summing unit 6.

Figure 4:
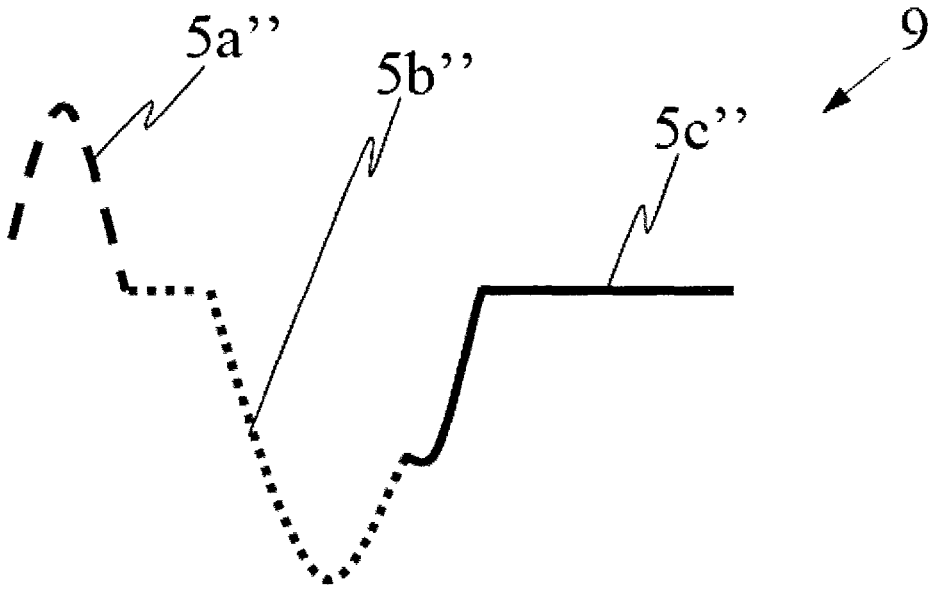
FIG. 4 depicts example interaction of example phase transitions of three example filter blocks.

FIG. 4 depicts example interaction of example phase transitions of three example filter blocks. Specifically, FIG. 4 depicts the phase response of the combined signal 9 from FIGS. 2 and 3, where single phase sections 5*a*", 5*b*" and 5*c*" result from the signal components 5*a*, 5*b*, and 5*c* and the respective processed signal components 5*a*', 5*b*', and 5*c*'.

Figure 5:
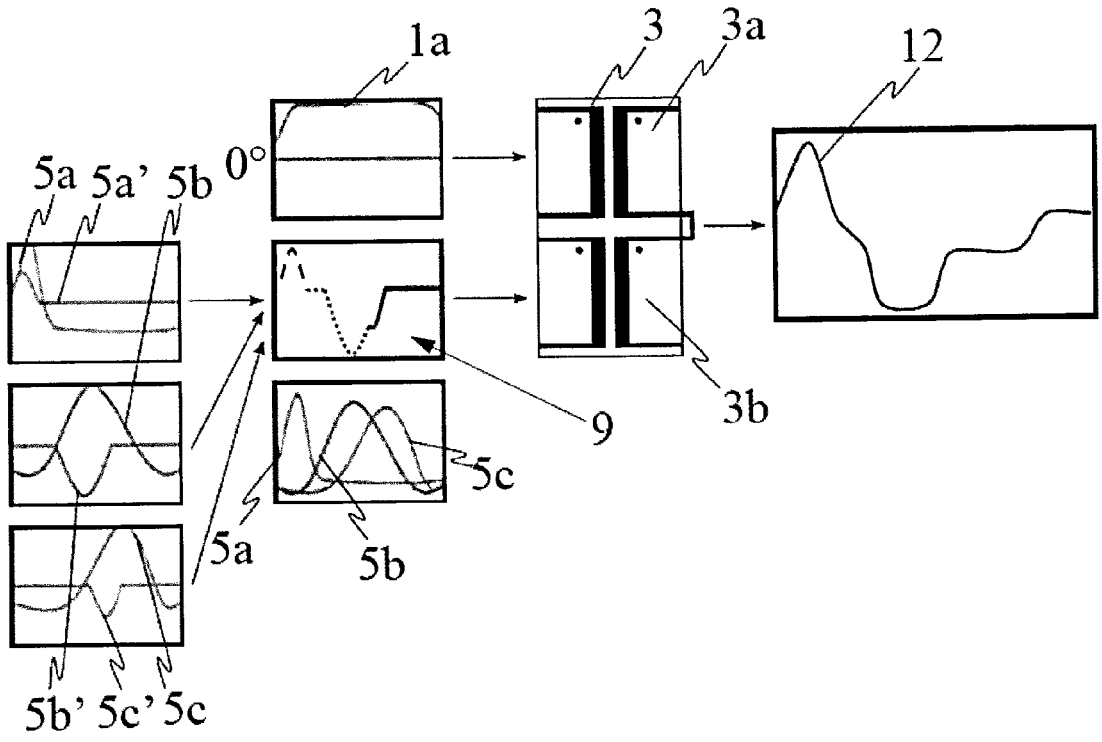
FIG. 5 depicts an example phase response of an example resulting composite signal, which may result from the example filter system illustrated in FIG. 1.

Active filtering, by the active filter 5, for example, may be based on the audio transformer 3, because the microphone 1 may be connected to a primary winding of the audio transformer 3. In FIGS. 1 and 5, the audio transformer 3 includes two pairs of coils 3*a* and 3*b*, with two primary windings and two secondary windings. The secondary windings may be connected in series and serve as a summer. The first primary winding of the audio transformer 3 may be directly connected to the microphone 1 and the second primary winding to the filter section 11.

Where the power supply 4 is not connected, the active filter 5 is deactivated or not functional and an original input signal la may be transformed directly via the first pair of coils 3*a* onto the secondary winding and played back by an amplifier, speaker, or recording device. Where the power supply 4 is connected, the original input signal la may be passed to the filter section 11 and may be processed by the active filter 5. Individual filter blocks of the active filter 5 may be constructed for different frequency ranges from active elements with active electronic elements, such as transistors and operational amplifiers. The signal modified by the active filter 5 may be fed to the second part of the primary winding of the audio transformer 3, and to the second pair of coils 3*b*. On the secondary winding, the signal may be added or subtracted with or from, respectively, the original input signal la, depending on the phasing of the original input signal la.

FIG. 5 depicts an example phase response of an example resulting composite signal, which may result from the example filter system illustrated in FIG. 1. Also, depicted is the audio transformer 3 connected as an adder. In a similar manner, it may be connected as a subtractor. In such an example, where a pure tone arrives with same phasing at inputs of the audio transformer 3, the pure tone may be emitted amplified at the output. This may be modeled by the following formula (1).

$$U_{out}=U_{in(Phase\ 0°)}+U_{diff(Phase\ 0°)} \quad (1)$$

Where $U_{out}$ is output voltage of the transformer.

Where $U_{in}$ is input voltage of the transformer.

And, where $U_{diff}$ is differential voltage of the transformer.

Where phasing of one of the inputs is shifted by θ° (such as where θ=180°), the pure tone may be attenuated at the output. This may be modeled by the following formula (2).

$$U_{out}=U_{in(Phase\ 0°)}+U_{diff(Phase-\theta°)} \quad (2)$$

From the audio transformer 3 the output signal 12 of the active filter system results, which may include aspects of the signal 9, the signal components 5*a*', 5*b*', and 5*c*', and the original input signal 1*a*.

The audio transformer 3 may be designed for a range of output impedance (such as an output impedance of 50-150 Ohms, where the transmission behavior reaches from about 10 Hz to 20 kHz, for example).

The active filter 5 can be any number of filter blocks and can be designed for any number of frequency bands. Depending on the setting of the individual potentiometers and the configuration of the amplifier and/or pole changer, as an adder or a subtractor, either an increase or a decrease in the individual phase sections 5*a*", 5*b*" and 5*c*" or of the output signal 12 may be obtained.

An example benefit of the microphone 1 with the audio transformer 3 compared to microphones with a power supply and built-in active filters, is a fully balanced retransmission of the audio signal to the next stage, such as forwarding the output to a mixer. Contrary to past microphones, the microphone 1 may be usable with the power supply 4 disconnected, and at the same time, a condenser or electret microphone. Or an external signal source can also be connected to the microphone 1 without unwanted distortions or artifacts in the outputted sound. In using the condenser and electret microphone, such devices may be fed with a power supply (such as power supply 4). Such feeding of power may be sourced by the filter system itself, which is illustrated by a power supply line 10 shown by a dashed line in FIG. 1.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A dynamic microphone, comprising:

an audio transformer that includes two pairs of coils; and a filter section that includes a signal converter, an active filter, a summing unit, and an amplifier, the active filter including one or more filter blocks for one or more respective signal components, the summing unit including one or more respective potentiometers for the one or more respective signal components, and the filter section and the audio transformer being operatively coupled to produce an audio signal independent of electrical impedance of downstream devices, where the audio transformer includes a first primary winding, a second primary winding, a first secondary winding, and a second secondary winding, and where the active filter is connected to the first primary winding, and where a microphone input is connected to the second primary winding.

2. The microphone according to claim 1, where the first secondary winding and the second secondary winding are connected in series and are operable as a summer.

3. The microphone according to claim 1, where:

the microphone is operable to receive an input signal;

the filter section is operable to process frequencies or phase characteristics of the input signal that produce a processed audio signal;

the transformer is operable to add or subtract the phase characteristics of the input signal that further enhance the processed audio signal; and the microphone is further operable to output the enhanced processed audio signal independent of electrical impedance of downstream devices.

4. The microphone according to claim 3, where:

the signal converter is operable to: convert one or more symmetrical aspects of the input signal to one or more asymmetrical aspects, and pass the one or more asymmetrical aspects to the active filter; and the active filter is further operable to process the frequencies or the phase characteristics of the input signal that produce the processed audio signal according to the one or more asymmetrical aspects.

* * * * *